United States Patent [19]

Lange

[11] 4,362,962

[45] Dec. 7, 1982

[54] ELECTRICAL TERMINAL CONNECTION FOR THE ELECTRODES OF A GAS DISCHARGE OVER-VOLTAGE ARRESTER

[75] Inventor: Gerhard Lange, Berlin, Fed. Rep. of Germany

[73] Assignee: Siemens Aktiengesellschaft, Berlin & Munich, Fed. Rep. of Germany

[21] Appl. No.: 225,769

[22] Filed: Jan. 16, 1981

[30] Foreign Application Priority Data

Feb. 19, 1980 [DE] Fed. Rep. of Germany ..... 3006193

[51] Int. Cl.[3] ..... H01J 5/50

[52] U.S. Cl. ..... 313/331; 313/335; 174/94 R

[58] Field of Search ..... 313/325, 331, 335; 174/84, 94 R

[56] References Cited

U.S. PATENT DOCUMENTS

| | | | |
|---|---|---|---|
| 2,427,727 | 9/1947 | Huntley et al. | 174/94 |
| 2,740,915 | 4/1956 | Jennings | 313/331 |
| 2,790,656 | 4/1957 | Cook | 174/94 |
| 3,278,778 | 10/1966 | Retzer | 313/331 |
| 3,422,302 | 1/1969 | Carpenter et al. | 313/331 |
| 3,876,894 | 4/1975 | Peche | 313/325 |
| 4,188,561 | 2/1980 | Pranke et al. | 313/325 |

*Primary Examiner*—Harold A. Dixon

*Attorney, Agent, or Firm*—Hill, Van Santen, Steadman, Chiara & Simpson

[57] ABSTRACT

In a gas discharge over-voltage arrester a welded connection is provided between electrodes thereof and connection wires preferably by means of long-time resistance welding of copper to copper. A respective peg with a diameter of approximately 9/10 and a length of approximately 6/10 of the diameter of the connection wire projects from the surfaces of the electrodes to be connected. The connection wire is welded blunt to the end surface of the peg.

12 Claims, 6 Drawing Figures

ELECTRICAL TERMINAL CONNECTION FOR THE ELECTRODES OF A GAS DISCHARGE OVER-VOLTAGE ARRESTER

BACKGROUND OF THE INVENTION

The invention relates to an electrical terminal connection for the electrodes of a gas discharge over or surge voltage arrester with the following features:

(a) the electrodes to be connected consist of a material with good current conductivity;

(b) the connection should respectively occur at a wire consisting of a material with good current conductivity.

Efficient over-voltage arresters must be able to arrest surge currents>10 kA. In dual-path over-voltage arresters, this meas that a sum current>20 kA flows across a common center electrode. Given electrical terminal connections via resiliently contacting contacts, such high surge currents cause sputtering of the contact material and thereby damage the sockets. Terminal wires which are soldered in and which generally consist of copper and then exhibit a diameter of approximately 1 mm offer a better electrical terminal connection for such currents. Copper is likewise preferably selected as the electrode material for electrical and economic reasons. The rigid connection between the electrode and the terminal wire can then be produced by means of soldering or welding.

Both are proposed, for example, in German OS No. 28 28 650, incorporated herein by reference. On the one hand, the possibility is there described of soldering a tubular rivet to the floor of the cup-shaped electrode and then squeezing (FIG. 4) the terminal wire in the tubular rivet. On the other hand, a welded connection is provided to "press" a cylinder to the floor of the cup-shaped electrode, the diameter of said cylinder being approximately 1.5 times as great as the diameter of the terminal wire. The terminal wire is welded blunt to said cylinder. Said cylinder has the object of reducing the thermal dissipation during the welding operation. Welding to the smooth bottom of the electrode or, respectively, to the jacket surface of a center electrode would not be possible given material which has high current conductivity and, thus also has high thermal conductivity.

Even given a cylinder dimensioned in such manner, however, a welded connection is only possible as a short-time welding, for instance as pulsed resistance welding. Particularly given a connection of copper to copper, this, however produces unreliable connections.

SUMMARY OF THE INVENTION

An object of the present invention is to design the electrodes of a gas discharge over-voltage arrester in such manner that a long-time resistance welding is possible which, for economical reasons, cannot only be produced with automatic welding units, but is also mechanically and electrically reliable.

The following features are proposed for achieving this object for an electrical terminal connection of the type initially cited:

(c) a peg with a diameter of approximately 9/10 and with a length of 5/10 through 8/10, and preferably 6/10 of the wire diameter, respectively projects from the electrodes to be connected;

(d) the end of the terminal wire is welded blunt to the respective peg.

Given this dimension, particularly given copper for the electrodes and terminal wires as a material which exhibits good current and thermal conductivity, a secure welded connection is possible. The uniformly high temperature of both parts to be connected, which is necessary for the welding, is achieved by means of the balanced, reduced thermal dissipation from the welding zone of the electrode resulting from the above dimensions. The mechanical stability and electrical carrying capacity of the connection are guaranteed.

Two embodiments are fundamentally possible for the peg. Either it is produced at the same time as the manufacture of the electrode without metal-cutting treatment by means of direct formation in, for example, an extrusion operation, or it is formed after the manufacture of the electrode by means of metal-cutting working, for example, by means of milling.

According to another embodiment of the invention, a respective cup-shaped electrode extending into the inside of the gas discharge over-voltage arrester with its thickened floor exhibits a peg in the inside of the cup on the side of the floor directed toward the outside. According to a further embodiment, given a dual path over-voltage arrester, an annular central electrode carries a peg at at least one peripheral location of its outside surface.

DESCRIPTION OF THE PREFERRED EMBODIMENTS

Figure 1:
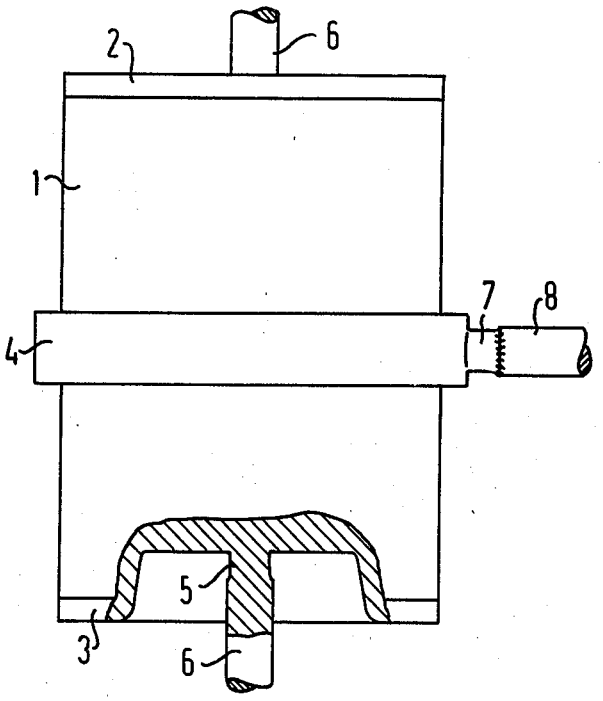
FIG. 1 is a front view of and FIG. 2 is an axial plan view of a dual-path gas discharge over-voltage arrester in which the pegs project out of the level of the surrounding electrode surfaces.
Figure 2:
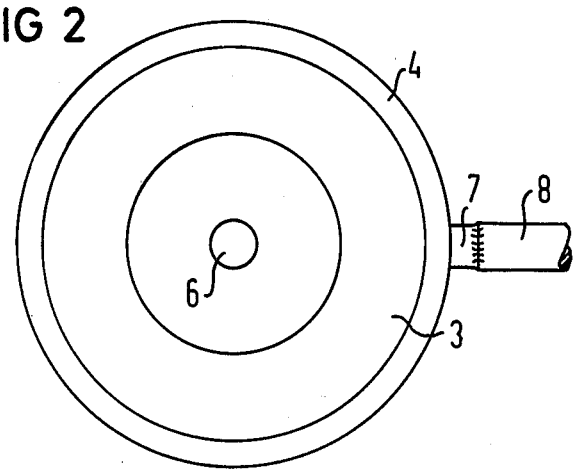

A dual path gas discharge over-voltage arrester is illustrated in FIG. 1 in which a tubular insulator 1 respectively carries a cup-shaped electrode 2 or, respectively, 3 at its two ends and an annular central electrode 4. The cup-shaped electrodes lie on the end faces of the insulator 1 by their edges and project into the inside of the insulator 1 with their solid floors. A respective cylindrical peg or terminal 5 consisting of the same material, for example copper, is centrally seated on the floor of the cup-shaped electrodes 2 and 3 and projects toward the outside. The end surface of an electrical connection wire 6 consisting of copper is welded to the outer end surface of the peg. The diameter of the peg 5 amounts to approximately 9/10 of the diameter of the connection wire 6; the axial length amounts to approximately 6/10 of the diameter of the connection wire 6 as the optimum value in the range from 5/10 through 8/10. The central electrode 4, with a greater outer diameter than that of the insulator 1, exhibits a radially projecting peg or terminal 7 at a peripheral location, said peg 7 having the same dimensioning as the peg 5. The end surface of a connection wire 8 consisting of copper is welded to the outer end surface of the peg 7.

At least in their rough dimensions, the pegs 5 and 7 arise simultaneously with the manufacture of the electrodes 2, 3 and 4, for example by means of extrusion.

Metal-cutting re-working is advantageous for precise dimensioning.

Figure 3:
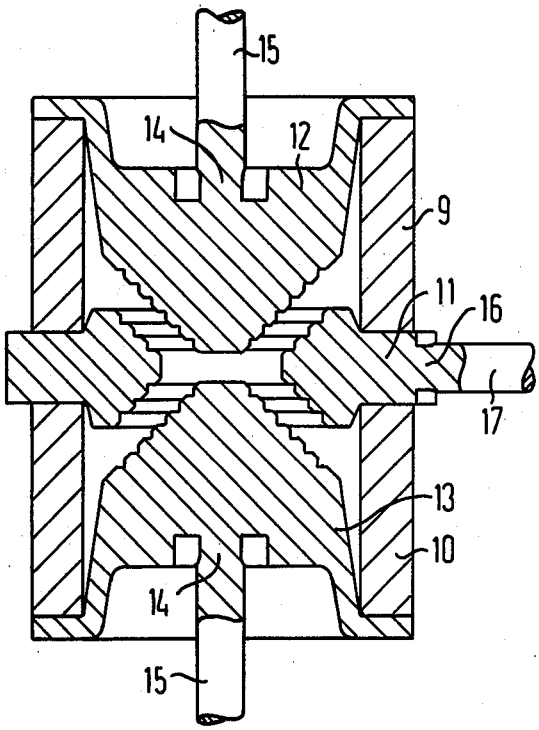
FIG. 3 is a longitudinal section of and FIG. 4 is an axial plan view of a dual-path gas discharge over-voltage arrester in which the pegs have been produced by means of milling into the surrounding electrode surface and do not project beyond these surfaces.

A dual-path gas discharge over-voltage arrester is illustrated in longitudinal section in FIG. 3. In this dual-path gas discharge over-voltage arrester two tubular insulators 9 and 10 are connected axially aligned with an annular central electrode 11 lying axially in between them, and being connected at their other ends with a cup-shaped electrode 12 or, respectively, 13. On the inside, the electrodes 11 through 13 are respectively provided as a sollid with step-shaped, active electrode surfaces facing one another. They consist of copper. The edges of the electrodes 12 and 13 again lie on the respective end surfaces of the insulators 9 and 10. Annular grooves are respectively milled into the cup floors and, by so doing, pegs 14 are formed whose outer end surfaces do not project beyond the outsides of the cup floors. The outer end surfaces of the pegs 14 are the weld connection surfaces to the end surfaces of the connection wires 15, consisting of copper. The pegs 14 again have a diameter of approximately 9/10 of the wire diameter and a length of approximately 6/10 of the wire diameter.

A peg 16 radially projecting toward the outside is formed by means of radial milling of an annular groove at an outer, peripheral location of the central electrode 11, a connection wire 17 consisting of copper being welded to the outer end surface of said peg 16. Its dimensioning corresponds to that of peg 14.

Figure 4:
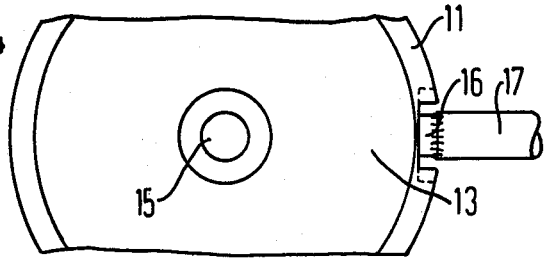
Figure 5:
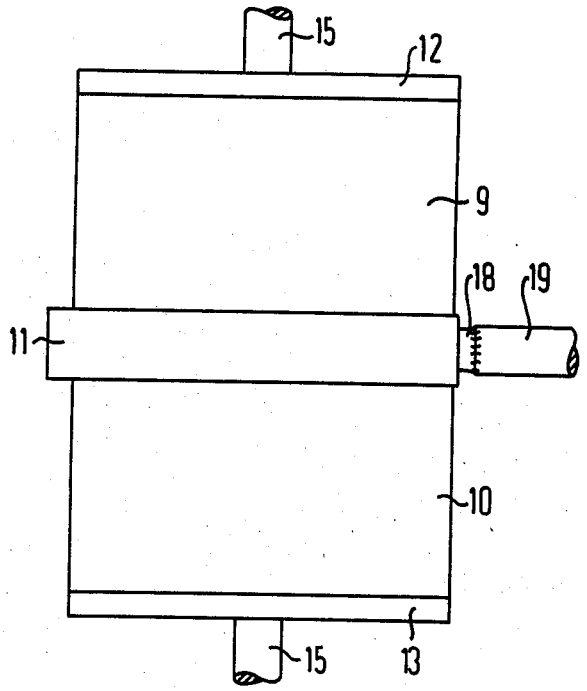
FIGS. 5 and 6 are a variation of FIGS. 3 and 4 relating to the central electrode.
Figure 6:
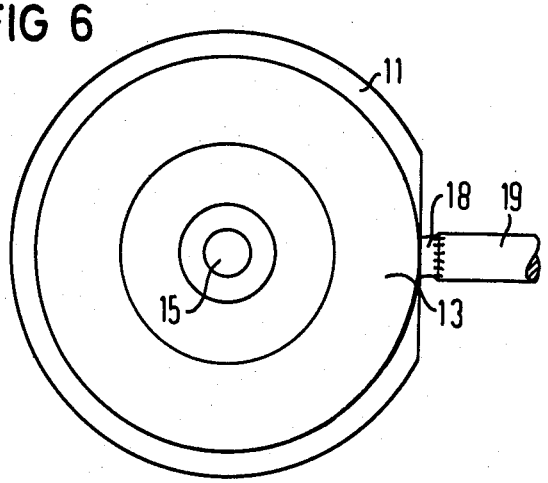

The sample embodiment illustrated in FIGS. 5 and 6 corresponds to that of FIGS. 3 and 4, with the sole difference being that the annular groove which forms the peg 18 on the outside of the central electrode is expanded so that an entire segment—except for the peg 18—is removed from the central electrode 11. That is, there is no edge portion of the central electrode 11 which coaxially surrounds the peg 18. A connection wire 19 is welded to the peg 18. Its dimensioning corresponds to that of peg 16.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An electrical terminal connection system for electrodes of a gas discharge over-voltage arrester, comprising:

an electrode of the arrester to be connected comprising a high current conductivity material;

a connection wire comprising a high current conductivity material;

a peg projecting from the electrode to be connected and having a diameter of approximately 9/10 and a length of 5/10 to 8/10 of the diameter of the connection wire; and an end surface of the connection wire being welded blunt to an end surface of the peg.

2. An electrical terminal connection system according to claim 1 wherein the peg is extruded and projects from the electrode.

3. An electrical terminal connection system according to claim 1 wherein the peg is milled.

4. An electrical terminal connection system according to claim 1 wherein the electrode and the terminal wire are comprised of copper.

5. An electrical terminal connection system according to claim 1 wherein an outer surface of the electrode has a cup-shaped region with the peg projecting from a floor of the cup-shaped region.

6. An electrical terminal connection system of claim 1 wherein an outer surface of the electrode has a cup-shaped region with a further annular region in a floor of the cup-shaped region, said annular region surrounding the peg whose end terminates substantially flush with the floor of the cup-shaped region.

7. An electrical terminal connection system according to claim 1 wherein a dual path over-voltage arrester is provided having an annular central electrode and two end electrodes, the central electrode having a peg at at least one peripheral location of its outer surface.

8. A method for attaching connection wires to electrodes of a gas discharge over-voltage arrester adapted for handling high currents, comprising the steps of:

providing the electrode of the arrester to be connected with a high current conductivity material;

providing a connection wire for connection to the electrode with a high current conductivity material;

on the electrode providing a peg projecting therefrom having a diameter less than a diameter of the connection wire and a length of 5/10 to 8/10 of the diameter of the connection wire; and in a long-time resistance welding operation welding an end surface of the peg in blunt fashion to an end surface of the connection wire.

9. A method according to claim 8 including the further step of providing a diameter of the peg as approximately 9/10 of the diameter of the connection wire.

10. A method according to claim 8 wherein the peg is formed simultaneously with the electrode is an extruding operation.

11. The method of claim 8 wherein the peg is formed by milling away a portion of an outer surface of the electrode so as to form an annular region surrounding the peg.

12. A method according to claim 8 wherein the peg is formed on the electrode without metal cutting working.

* * * * *